US009754482B2

(12) United States Patent
Machida et al.

(10) Patent No.: US 9,754,482 B2
(45) Date of Patent: Sep. 5, 2017

(54) REMOTE CONTROL DEVICE AND REMOTE CONTROL SYSTEM

(71) Applicant: SMK Corporation, Tokyo (JP)

(72) Inventors: Yusuke Machida, Kanagawa (JP); Hiroshi Fujikawa, Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 15/246,552

(22) Filed: Aug. 25, 2016

(65) Prior Publication Data

US 2017/0193812 A1 Jul. 6, 2017

(30) Foreign Application Priority Data

Jan. 5, 2016 (JP) ..... 2016-000349

(51) Int. Cl.
*G08C 19/18* (2006.01)
*G08C 17/02* (2006.01)

(52) U.S. Cl.
CPC ..... *G08C 17/02* (2013.01); *G08C 2201/92* (2013.01)

(58) Field of Classification Search
CPC ..... G08C 17/02; G08C 2201/92
USPC ..... 340/12.5, 8.1, 539.13, 539.32; 455/41.1, 455/418; 700/56, 276
See application file for complete search history.

(56) References Cited

U.S. PATENT DOCUMENTS

2016/0255549 A1* 9/2016 Lakhdhar ..... H04W 24/10 370/332

FOREIGN PATENT DOCUMENTS

JP 2012-184968 A 9/2012
JP 2012184968 A * 9/2012

* cited by examiner

*Primary Examiner* — Dhaval Patel

(57) ABSTRACT

A control target device is specified using a remote control device with a simple configuration. The remote control device includes: a communication unit that receives a received signal strength from each of a plurality of electronic devices and transmits a predetermined control command to a control target device; and a control target device specifying unit that specifies, as the control target device, a device having a maximum variation of the received signal strength among the plurality of electronic devices. The communication unit includes an antenna disposed at an end of a housing, and the antenna has directivity at which a direction in which the end of the housing is directed to a reception side is a substantially null direction.

8 Claims, 18 Drawing Sheets

25

REMOTE CONTROL DEVICE AND REMOTE CONTROL SYSTEM

CROSS REFERENCE TO RELATED APPLICATION

The contents of the following Japanese patent application are incorporated herein by reference, Japanese Patent Application No. 2016-000349 filed on Jan. 5, 2016.

FIELD

The present disclosure relates to a remote control device and a remote control system.

BACKGROUND

A remote control system in which two-way communication is performed between an electronic device and a remote control device and a control is executed according to the result of the two-way communication has been conventionally proposed (for example, see JP-A-2012-184968 described below).

In the remote control device disclosed in JP-A-2012-184968, a plurality of antennas is used. This leads to an increase in cost due to, for example, an increase in the number of components, and it is necessary for the remote control device to execute processing for switching the plurality of antennas. However, in the remote control device of this type is required to have a simple configuration while increasing the number of components as little as possible.

SUMMARY

Therefore, an objective of the present disclosure is to provide a remote control device and a remote control system which are novel and useful for solving the above-mentioned problem.

In order to solve the above-mentioned problem, one aspect of the present disclosure is a remote control device including: a communication unit that receives a received signal strength from each of a plurality of electronic devices and transmits a predetermined control command to a control target device; and a control target device specifying unit that specifies, as the control target device, a device having a maximum variation of the received signal strength among the plurality of electronic devices. The communication unit includes an antenna disposed at an end of a housing, and the antenna has directivity at which a direction in which the end of the housing is directed to a reception side is a substantially null direction.

The communication unit may transmit a radio wave with a predetermined frequency from the antenna to the plurality of electronic devices. The antenna may have directivity at which a gain of the antenna is increased at a location where the end of the housing is moved by substantially 90 degrees in a vertical direction from a location in the substantially null direction.

The remote control device may include a sensor unit that detects whether or not a predetermined operation is performed.

The control target device specifying unit may calculate a variation of the received signal strength based on a received signal strength obtained a predetermined period of time before a predetermining timing obtained by the sensor unit, and on a received signal strength obtained after the predetermined period of time.

The remote control device may include a storage unit that stores, for each device, the received signal strength received from each of the plurality of electronic devices.

Another aspect of the present disclosure is a remote control system including a plurality of electronic devices and a remote control device.

The electronic devices each include: a first communication unit that receives a radio wave transmitted from the remote control device, and transmits a received signal strength of the radio wave to the remote control device, the first communication unit including a first antenna; and a received signal strength acquisition unit that acquires the received signal strength.

The remote control device includes: a second communication unit that receives a received signal strength from each of the plurality of electronic devices, and transmits a predetermined control command to a control target device; and a control target device specifying unit that specifies, as the control target device, a device having a maximum variation of the received signal strength among the plurality of electronic devices.

The second communication unit includes a second antenna disposed at an end of a housing, and the second antenna has directivity at which a direction in which the end of the housing is directed to a reception side is a substantially null direction.

The first antenna may have a shape that reduces a loss due to a mismatch between a polarization of the first antenna and a polarization of the second antenna.

According to the aspects of the present disclosure, the configuration of the remote control device can be simplified. Further, the device to be controlled (control target device) can be specified from the plurality of electronic devices by using the remote control device. The contents of the present disclosure should not be limitatively interpreted by the advantageous effects described herein.

DESCRIPTION OF EMBODIMENTS

Figure 1:
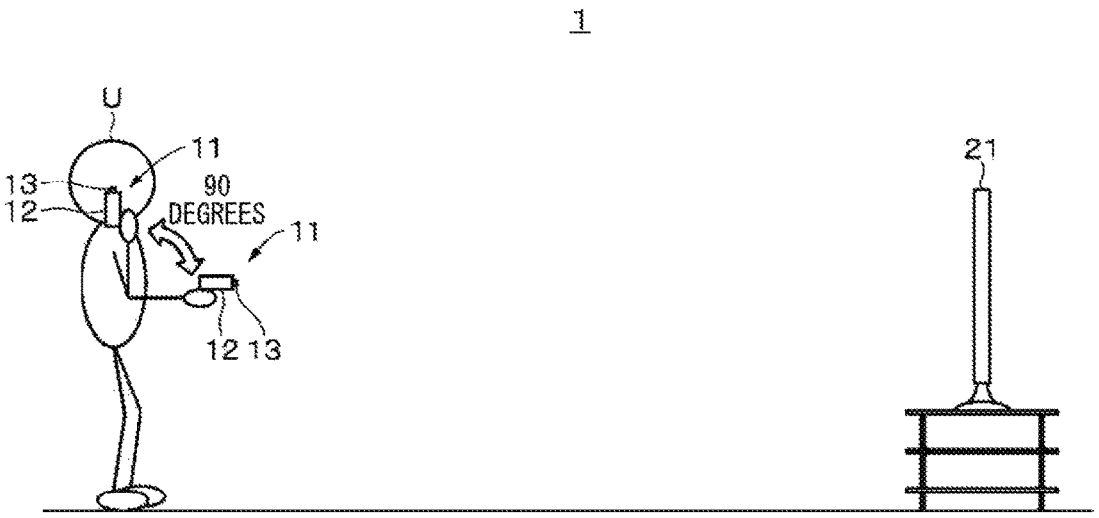
FIG. 1 is a diagram for explaining an outline of a remote control system according to an embodiment of the present invention.

Embodiments and the like of the present disclosure will be described below with reference to the drawings. <1. First embodiment>, <2. Second embodiment>, and <3. Modified example> will be described below in this order.

However, embodiments and the like to be described below illustrate configurations for embodying the technical idea of the present disclosure, and the present disclosure is not limited to the illustrated configurations. Note that the components set forth in the claims are in no way limited to the components illustrated in the embodiments. Unless specified in particular, structural component features described in the embodiments, such as dimensions, material, shape, and relative arrangement, and descriptions of directions, such as top, bottom, right, and left, are simply for the purpose of explanatory example and are in no way intended to limit the scope of the invention. The size, positional relationship, and the like of the components shown in the drawings may be exaggerated for the purpose of clear explanation. To prevent the illustration from being complicated, only some of the reference numerals may be used in the drawings. In the following description, components represented by the same name and reference numeral indicate the same or equivalent components, and detailed descriptions thereof are omitted as appropriate. Each component of the present disclosure may be configured to function as a plurality of elements by using one member for the plurality of elements. Alternatively, each component of the present disclosure may be achieved by sharing the function of one member among a plurality of components.

1. First Embodiment

Configuration Example of Remote Control System

FIG. 1 is a diagram showing an outline of a remote control system according to an embodiment of the present invention. A remote control system 1 includes a remote control device 11 that is operated by a user U, and a plurality of electronic devices 21A, 21B, . . . . If there is no need to distinguish the individual electronic devices, the electronic devices may be referred to simply as the electronic device 21 (the same holds true for the components included in the electronic device 21).

As shown in FIG. 1, in this embodiment, an operation for swinging the remote control device 11 is performed by the user U. This swing operation is a series of operations shifting from a state where the remote control device 11 is swung up to a state where the remote control device 11 is swung down by substantially 90 degrees. In the state where the remote control device 11 is swung up, an end of the remote control device 11 is directed upward. In the state where the remote control device 11 is swung down (the swing operation is finished), the end of the remote control device 11 is directed to a desired electronic device 21 to be operated by the user, and any electronic device 21 to be operated is present on a forward extension of the end of the remote control device 11.

The electronic device 21 is a device such as a television device, an audio reproducing device, a recording/reproducing device, or a personal computer. However, the electronic device 21 is not limited to these devices. Any device, such as an air conditioning device or an illumination device, may be used as the electronic device 21, as long as the remote control device 11 can perform a remote control operation on the electronic device.

Configuration Example of Each Device

Figure 2:
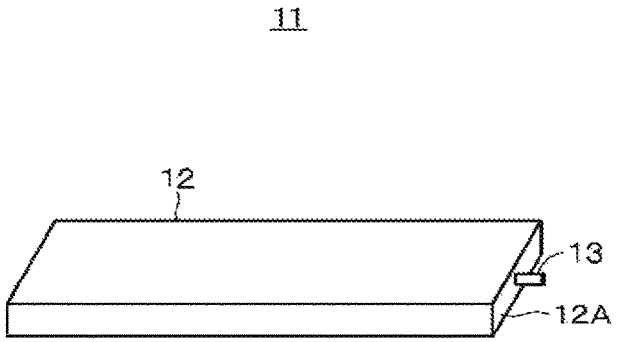
FIG. 2 is a diagram for explaining an example of the shape of the remote control device according to the embodiment of the present invention.

Next, a configuration example of each device constituting the remote control system 1 will be described with reference to FIGS. 2 and 3. FIG. 2 is a diagram showing an example of the shape (appearance) of the remote control device 11. The remote control device 11 includes a housing 12 having, for example, a rectangular parallelepiped shape. The remote control device 11 in this embodiment has a simple configuration in which an operation input unit, such as a button, is not disposed on the housing 12, unlike the general remote control device. An antenna 13 is disposed on one side surface 12A which is a short-axis side of the remote control device 11. The side surface 12A is a portion corresponding to an end of the housing 12.

The antenna 13 is an antenna having directivity. In this embodiment, a monopole antenna is used as the antenna 13. As described in detail later, the antenna 13 is an antenna element having directivity at which the direction in which the end (side surface 12A) of the remote control device 11 is directed to a reception side is a null direction. Note that the null direction refers to a direction corresponding to a portion (null point) at which the gain of the antenna 13 decreases significantly.

Figure 3:
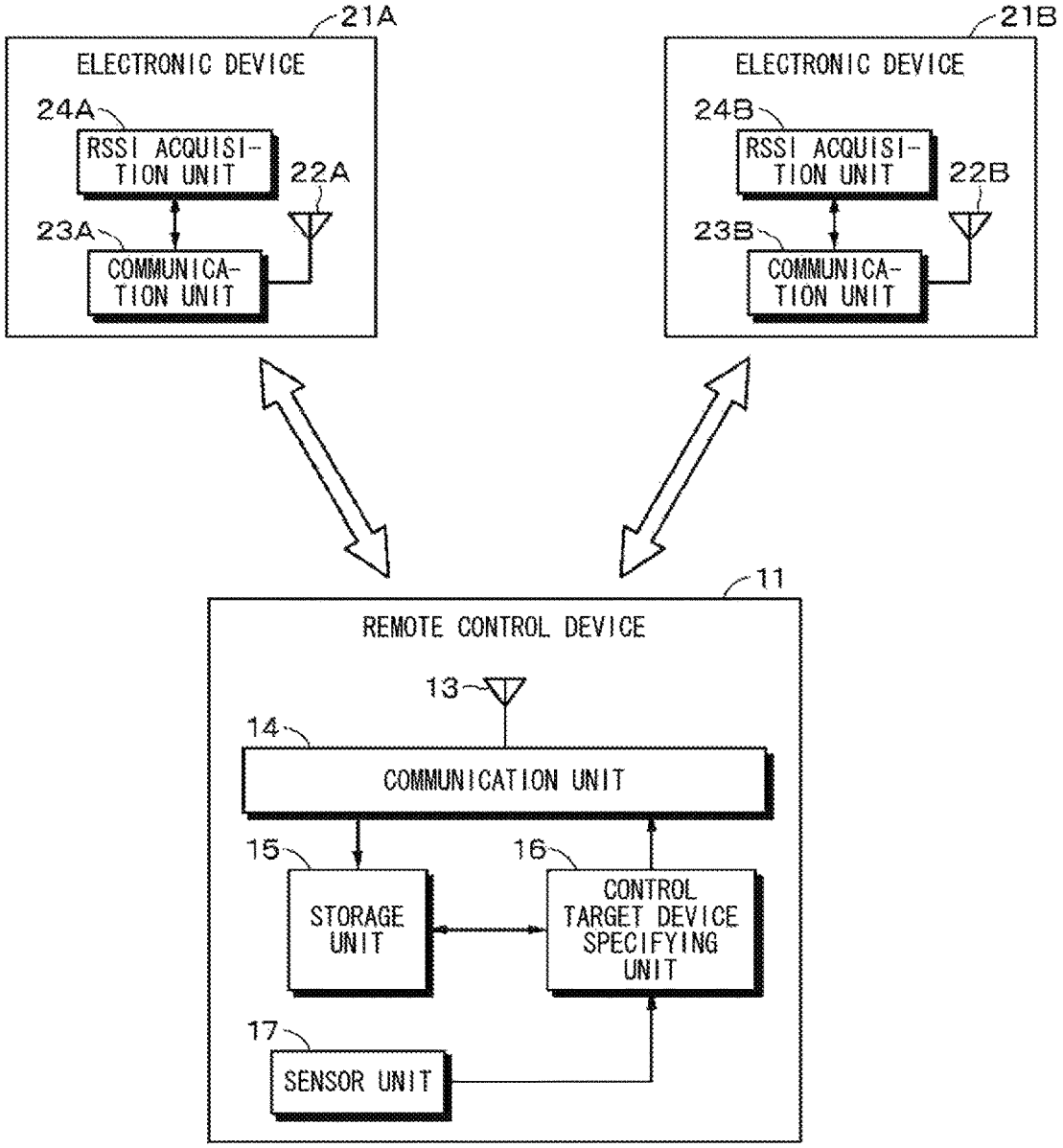
FIG. 3 is a block diagram for explaining a configuration example of each device constituting the remote control system according to the embodiment of the present invention.

FIG. 3 is a diagram for explaining an electrical configuration example of each device constituting the remote control system 1. The remote control device 11 includes a communication unit 14 including the antenna 13 described above, a storage unit 15, a control target device specifying unit 16, and a sensor unit 17.

The communication unit 14 executes appropriate processing, such as demodulation processing and error connection processing, on a signal received via the antenna 13. Further, the communication unit 14 executes modulation processing or the like for generating and transmitting a radio wave with a predetermined frequency band (for example, 2.4 GHz (gigahertz)) and a control command for the electronic device 21. The radio wave and the control command are transmitted to the electronic device 21 via the communication unit 14. Each electronic device 21 transmits an RSSI (Received Signal Strength Indicator) indicating the received signal strength of the radio wave to the remote control device 11, and the communication unit 14 receives the RSSI.

Near field communication based on a predetermined communication standard is established between the remote control device 11 and the electronic device 21. Examples of the predetermined communication standard may include communication based on a short range/low power consumption type ANT standard, communication based on Zigbee (Registered) standard, and communication based on Bluetooth (Registered) standard.

The storage unit 15 is a generic term for memories, such as a program ROM (Read Only Memory) for executing the operation of the remote control device 11 and a rewritable RAM (Random Access Memory), and drivers for recording and reproducing data. For example, the storage unit 15 stores the RSSI, which is transmitted from the electronic device 21, in such a manner that the RSSI is associated with the ID (Identifier) of each electronic device.

The control target device specifying unit 16 specifies a control target device from the plurality of electronic devices 21, and is composed of a CPU (Central Processing Unit), a microcomputer, or the like. The control target device specifying unit 16 analyzes the RSSI stored in the storage unit 15, and specifies a device having a maximum variation of the RSSI as the control target device. The control target device specifying unit 16 supplies the ID indicating the control target device to the communication unit 14.

The sensor unit 17 is, for example, a three-axis acceleration sensor. A sensor signal obtained by the sensor unit 17 is input to the control target device specifying unit 16.

Next, a configuration example of the electronic device 21 will be described. Although the electronic device 21A will be described below by way of example, the components included in the electronic device 21A are also included in the electronic device 21B.

The electronic device 21A includes a communication unit 23A including an antenna 22A, and an RSSI acquisition unit 24A. The antenna 22A is an antenna element that periodically receives the radio wave transmitted from the remote control device 11. The antenna 22A in this embodiment is a dipole antenna. The communication unit 23A executes appropriate processing, such as demodulation processing and error correction processing, on the radio wave and the control command received by the antenna 22A. Further, the communication unit 23A generates transmitted data to which the ID obtained by adding the ID indicating the electronic device 21A to the RSSI measured by the RSSI acquisition unit 24A, and the antenna 22A transmits the transmitted data to the remote control device 11.

The RSSI acquisition unit 24A is a circuit that measures the RSSI which indicates the electric field strength of the radio wave received by the antenna 22A. The RSSI acquisition unit 24A supplies the measured RSSI to the communication unit 23A.

A configuration example of each device has been described above. Note that the components described above may be configured as a one-chip communication module. The electronic devices 21A and 21B may include a component (for example, a display or a speaker) depending on the intended use.

Directivity of Antenna

Next, the directivity of the antenna 13 included in the remote control device 11 will be described. Specifically, the directivity measured when a monopole antenna is used as the antenna 13 and a dipole antenna is used as the antenna 22 on the reception side (on the side of the electronic device 21) will be described.

Figure 4A:
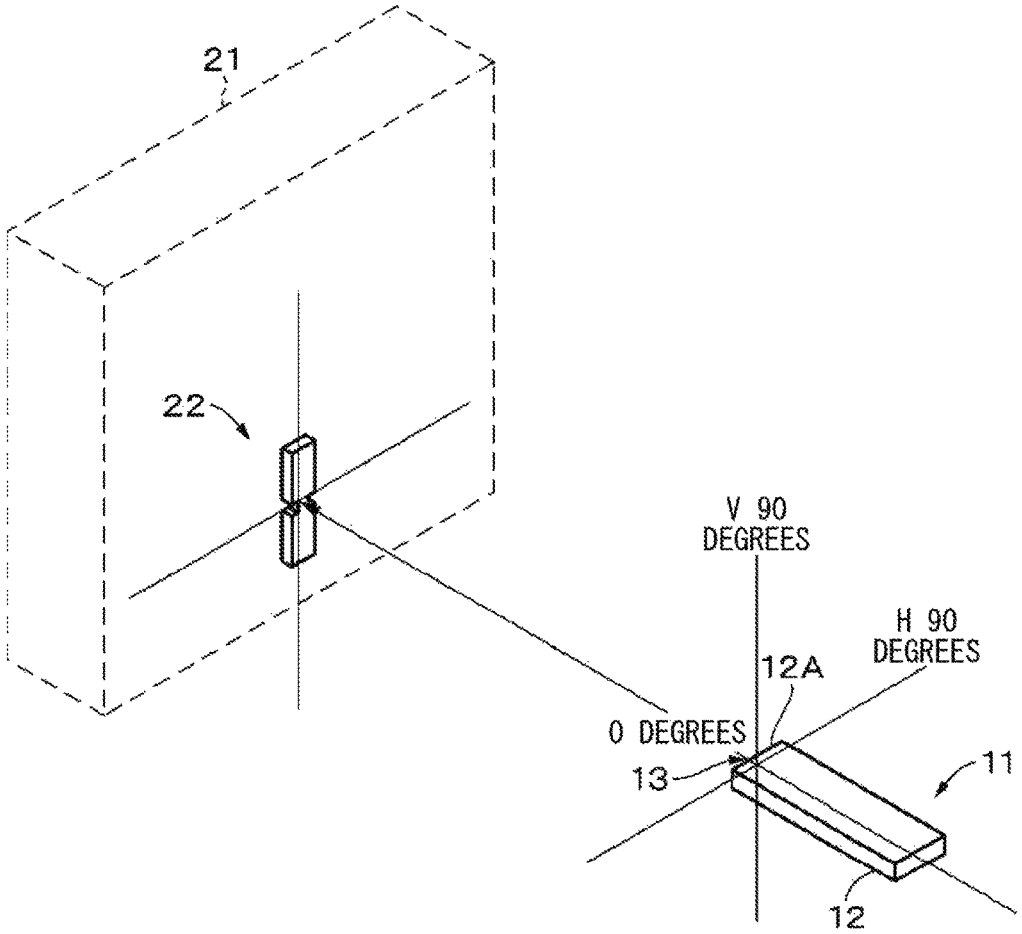
FIG. 4A is a diagram for explaining the directivity of an antenna included in the remote control device according to the embodiment of the present invention.
Figure 4B:
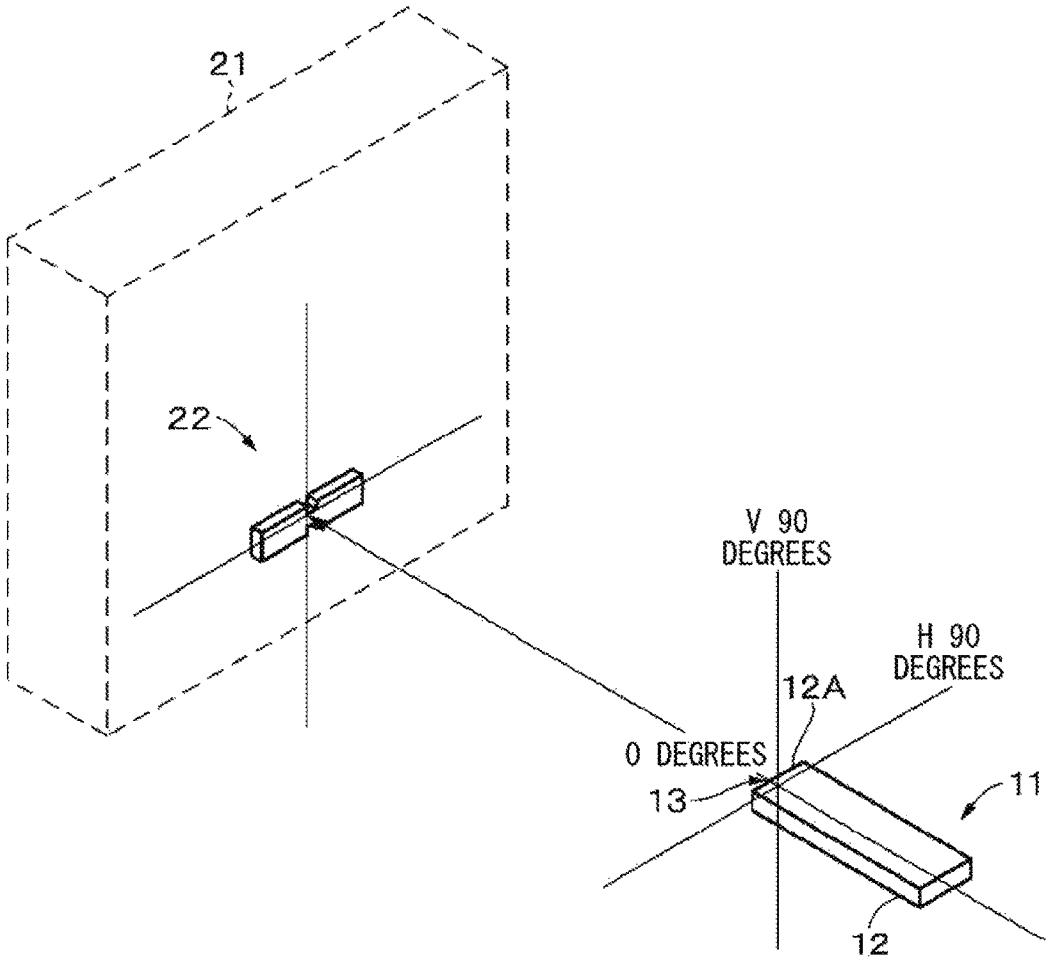
FIG. 4B is a diagram for explaining the directivity of an antenna included in the remote control device according to the embodiment of the present invention.

FIGS. 4A and 4B are diagrams each showing a relative positional relationship between the remote control device 11 and the antenna 22. FIG. 4A shows a positional relationship in which the remote control device 11 is disposed in such a manner the side surface 12A, which is an end of the remote control device 11, is directed to the antenna 22 and the antenna 22 is disposed so as to be vertical to the remote control device 11. A vertical direction (V) and a horizontal direction (H) are defined as shown in FIG. 4A, assuming that the direction of the extension of the end of the remote control device 11 is set to 0 degrees. On the other hand, FIG. 4B shows a positional relationship in which the remote control device 11 is disposed in such a manner that the side surface 12A, which is an end of the remote control device 11, is directed to the antenna 22 and the antenna 22 is disposed so as to be horizontal to the remote control device 11. Like in FIG. 4A, the vertical direction and the horizontal direction are defined as shown in FIG. 4B, assuming that the direction of the extension of the end of the remote control device 11 is set to 0 degrees.

Figure 5A:
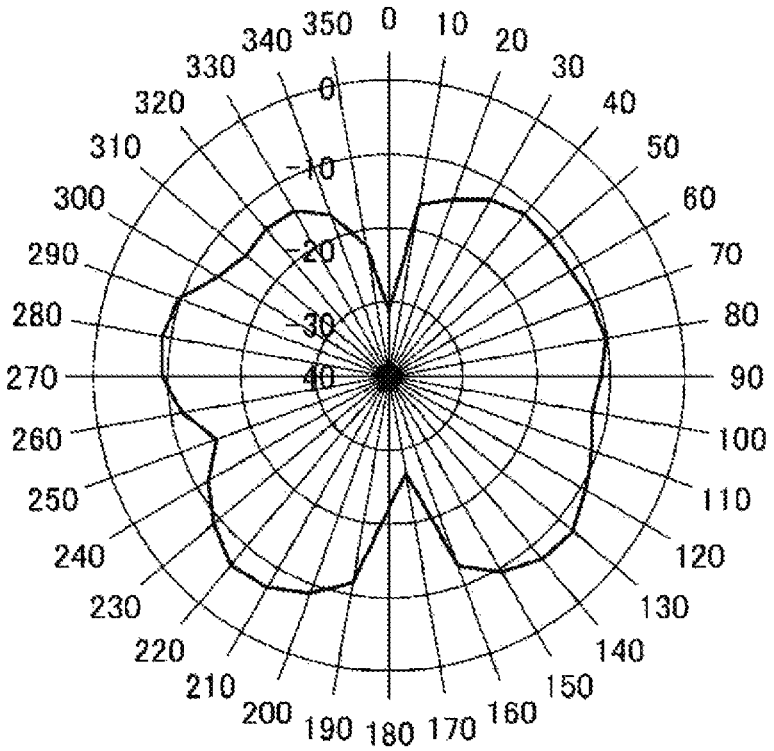
FIG. 5A is a diagram for explaining the directivity of the antenna included in the remote control device according to the embodiment of the present invention.
Figure 5B:
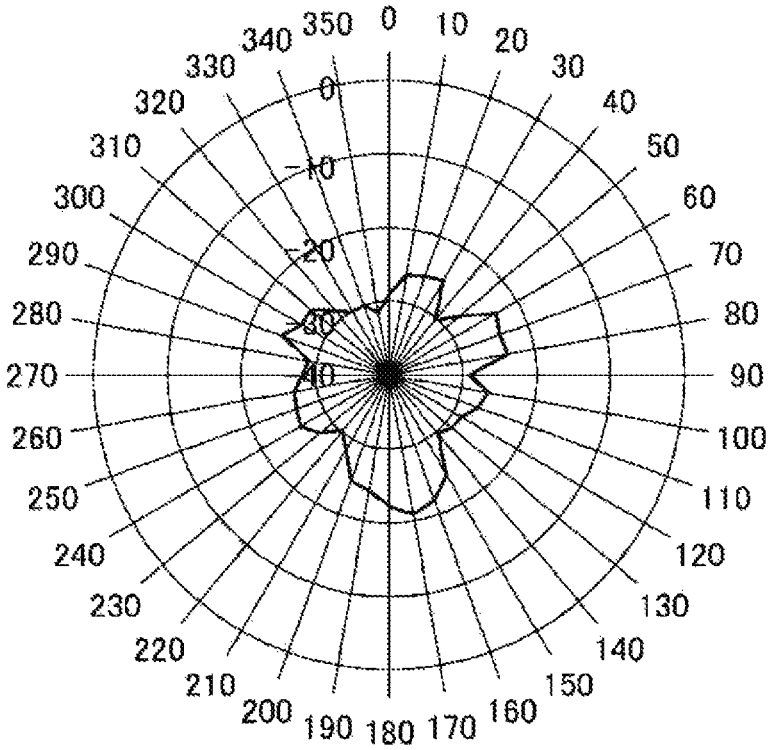
FIG. 5B is a diagram for explaining the directivity of the antenna included in the remote control device according to the embodiment of the present invention.

FIG. 5A shows characteristics (directivity) in the vertical direction indicating the gain (dBi) at each angle of the antenna 13 that is measured in the arrangement example shown in FIG. 4A, and FIG. 5A shows characteristics (directivity) in the horizontal direction indicating the gain (dBi) at each angle of the antenna 13 that is measured in the arrangement example shown in FIG. 4A. As shown in FIG. 5A, the direction in which the gain in the direction (0 degrees) in which the side surface 12A, which is an end of the remote control device 11, is directed to the reception side decreases significantly is the null direction. The range of an angle at the null point where the gain decreases significantly is small, while the difference between the gain and another angle is large. For example, the gain is increased at a location (for example, a state where the remote control device 11 is erected) where the side surface 12A is moved by substantially 90 degrees in the vertical direction from a location of 0 degrees. As shown in FIG. 5B, in a state (lateral state) in which the remote control device 11 is placed in the horizontal direction, the polarization of the antenna 13 does not match the polarization of the antenna 22, which leads to a decrease in the characteristics.

Figure 6A:
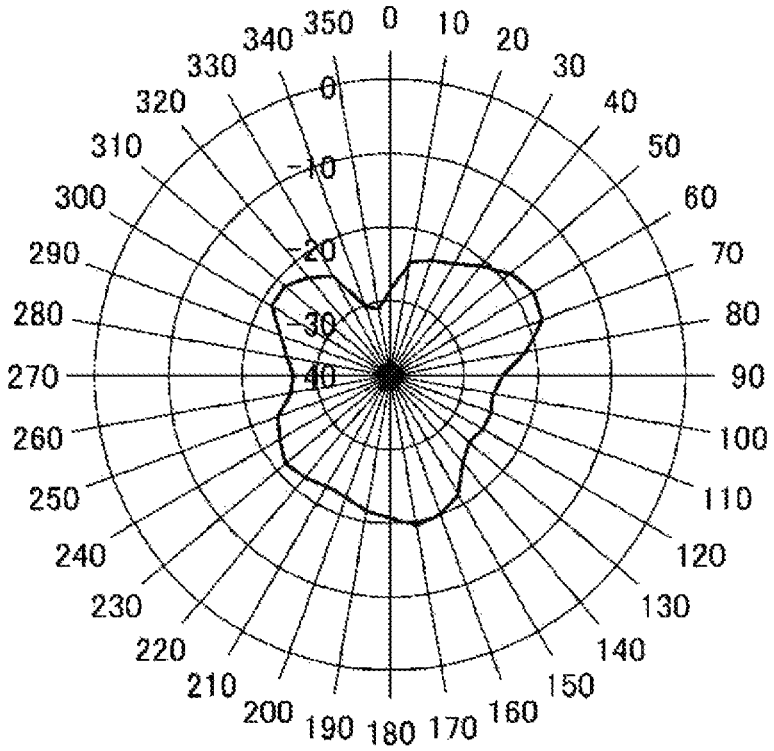
FIG. 6A is a diagram for explaining the directivity of the antenna included in the remote control device according to the embodiment of the present invention.
Figure 6B:
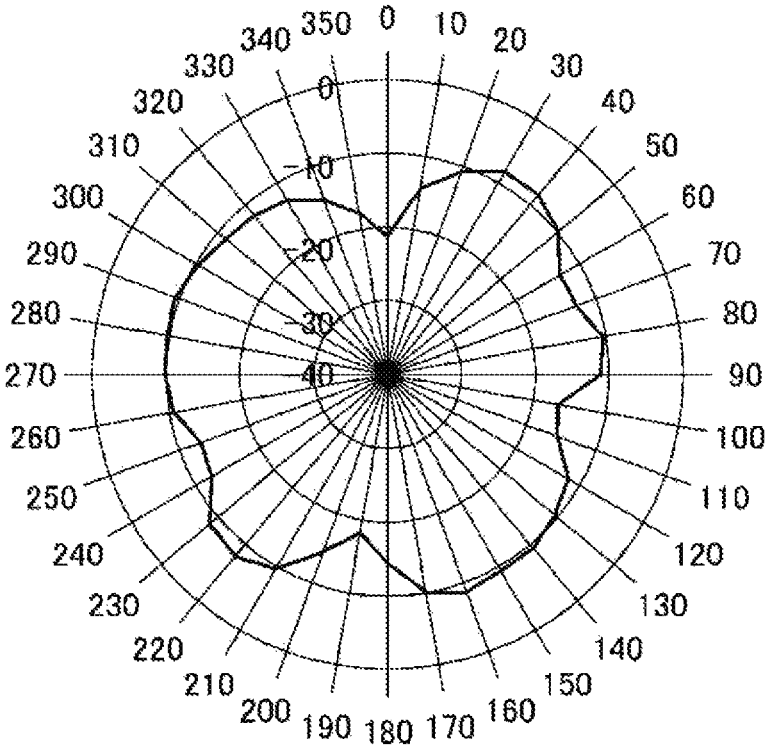
FIG. 6B is a diagram for explaining the directivity of the antenna included in the remote control device according to the embodiment of the present invention.

FIG. 6A shows characteristics (directivity) in the vertical direction indicating the gain (dBi) at each angle of the antenna 13 that is measured in the arrangement example shown in FIG. 4B, and FIG. 6B shows characteristics in the horizontal direction indicating the gain (dBi) at each angle of the antenna 13 that is measured in the arrangement example shown in FIG. 4B. As shown in FIG. 6A, in the vertical direction (in the state where the remote control device 11 is erected), the polarization of the antenna 13 does not match the polarization of the antenna 22, which leads to a decrease in the characteristics. On the other hand, as shown in FIG. 6B, the direction in which the end of the remote control device 11 is directed to the reception side is the null direction. The range of an angle at the null point where the gain decreases significantly is small, while the difference between the gain and another angle is large.

On the basis of the above-described characteristics, the electronic device to be operated by the user U is specified as follows in this embodiment. The user U performs the operation of swinging the remote control device 11 toward the electronic device 21 to be operated. Specifically, the remote control device 11 is erected in such a manner that the antenna 13 is located in the vicinity of 90 degrees in the vertical direction, and the remote control device 11 is swung down from the location and the antenna 13 is stopped at a location in the vicinity of 0 degrees.

In a state where the remote control device 11 is swung up, the strength of the radio wave received by the antenna 22 increases and the RSSI increases. On the other hand, in a state where the remote control device 11 is swung down and the end of the remote control device 11 is directed to the antenna 22, the strength of the radio wave received by the antenna 22 decreases and the RSSI decreases. In this manner, when the operation of swinging the remote control device 11 is performed, a variation of the RSSI in the electronic device 21 directed to the remote control device 11 increases. Thus, the electronic device 21 having a maximum variation of the RSSI among the plurality of electronic devices 21 can be specified as the electronic device to be operated by the user U, and the electronic device can be specified as the control target device.

The remote control device 11 transmits, for example, a control command for power-on to the control target device. Accordingly, it is possible for the user U to power on the electronic device 21 only by swinging the remote control device 11, and thus an intuitive remote control operation can be performed.

Processing Flow

Figure 7:
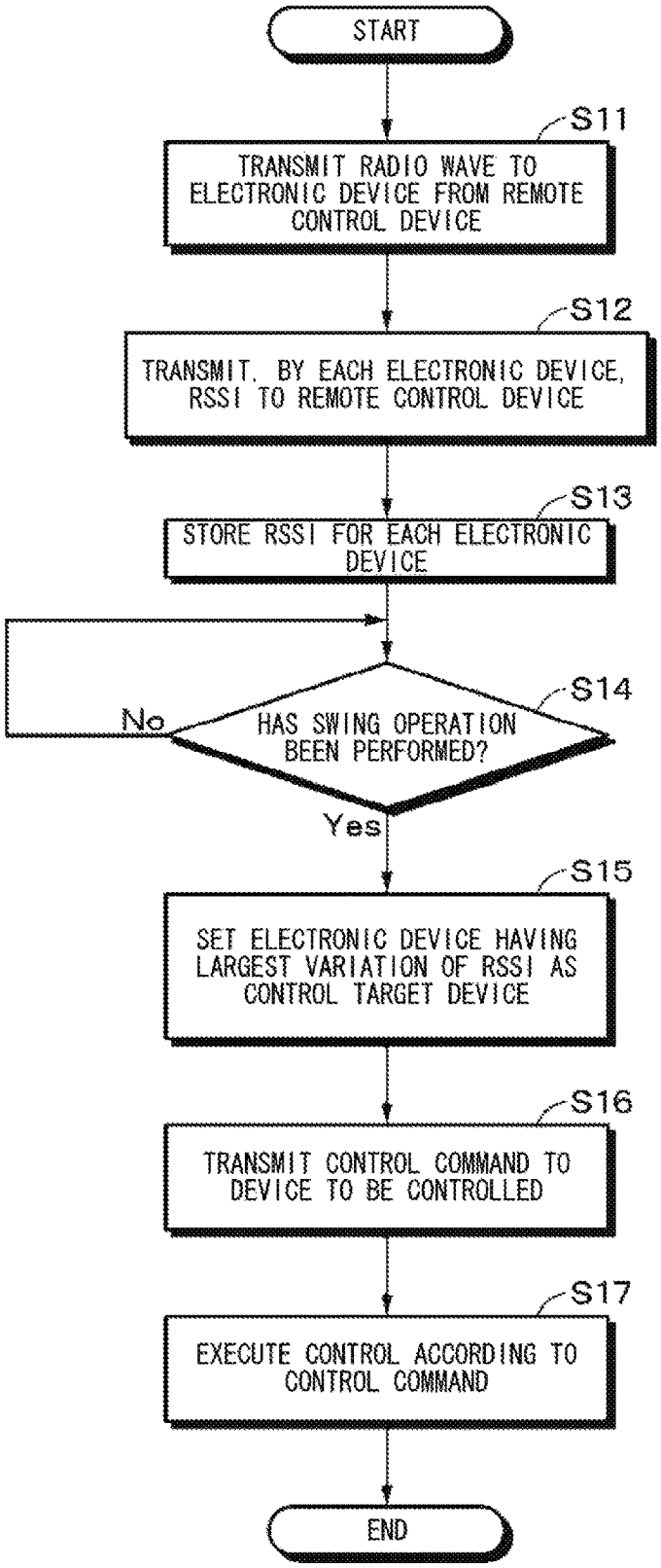
FIG. 7 is a flowchart for explaining a processing flow according to a first embodiment of the present invention.

A detailed processing flow will be described with reference to the flowchart shown in FIG. 7. In step S11, the remote control device 11 periodically transmits the radio wave with the predetermined frequency band to the peripheral electronic devices 21. The peripheral electronic devices 21 receive the radio wave transmitted from the remote control device 11, and the RSSI acquisition unit 24 of each electronic device 21 which has received the radio wave acquires the RSSI. Then, the processing proceeds to step S12.

In step S12, each electronic device 21 transmits, to the remote control device 11, the acquired RSSI as well as the ID of the corresponding electronic device. For example, the electronic device 21 transmits, to the electronic device 21, data on the RSSIs of 10 to 20 samples per second. Then, the processing proceeds to step S13.

In step S13, the remote control device 11 stores the received RSSIs in the storage unit 15. The remote control device 11 stores the RSSIs in chronological order in such a manner that the RSSI is associated with the ID of each electronic device. Then, the processing proceeds to step S14.

In step S14, it is determined whether or not the swing operation has been performed on the remote control device 11. For example, the control target device specifying unit 16 determines whether or not the swing operation has been performed based on an output from the sensor unit 17. In step S14, when it is determined that the swing operation has not been performed, the processing proceeds to step S14. In step S14, when it is determined that the swing operation has been performed, the processing proceeds to step S15.

In step S15, the control target device specifying unit 16 calculates a variation of the RSSI for each electronic device when the swing operation is performed on the remote control device 11. For example, the control target device specifying unit 16 calculates a variation of the RSSI as follows. The control target device specifying unit 16 determines a timing (hereinafter referred to as a timing t) when the swing operation is performed on the remote control device 11, based on the output from the sensor unit 17. Further, the control target device specifying unit 16 obtains an average value of RSSIs corresponding to predetermined device IDs stored in the storage unit 15. For example, the control target device specifying unit 16 obtains an average value (hereinafter referred to as a first average value) of a plurality of RSSIs which are obtained one second before the timing t and stored, and an average value (hereinafter referred to as a second average value) of a plurality of RSSIs which is obtained one second after the timing t and stored. The control target device specifying unit 16 obtains a difference between the first and second average values as a variation of the RSSI.

The control target device specifying unit 16 obtains a variation of the RSSI for each electronic device. Further, the control target device specifying unit 16 identifies the ID at which the variation of the RSSI is maximum, and the electronic device 21 corresponding to the ID is set as the control target device. Then, the processing proceeds to step S16.

In step S16, the ID corresponding to the control target device is supplied to the communication unit 14 from the control target device specifying unit 16. The communication unit 14 generates a control command to which the supplied ID is added, and transmits the control command from the antenna 13. The control command in this embodiment is a command for turning on or off the power. Then, the processing proceeds to step S17.

In step S17, the control according to the control command is executed. The electronic device 21 which has received the control command can determine whether or not the control command is addressed to the electronic device 21, by referring to the ID included in the control command. The electronic device 21 which has determined that the control command is addressed to the electronic device 21 performs control depending on the content of the control command, for example, turns on or off the power.

The above processing makes it possible to specify the electronic device 21 to which the user U has directed the remote control device 11, in other words, the electronic device 21 which is considered to be operated by the user U. The remote control device 11 in this embodiment need not to be provided with a plurality of buttons, a plurality of antennas, and the like, so that the configuration and processing can be simplified. Furthermore, the control for the electronic device 21 to be operated can be executed only by an intuitive operation such as a swing operation.

2. Second Embodiment

Next, a second embodiment will be described. Note that in the following description, unless otherwise noted, the same names and reference numerals represent the same or equivalent components, and repeated explanations are omitted as appropriate. In addition, unless otherwise noted, the matters described in the first embodiment can be applied to the second embodiment. The second embodiment is schematically explained as an embodiment in which, like in the first embodiment, the control target device is specified based on a variation of the RSSI, and solves the problem of false recognition of the control target device that can be caused by the positional relationship between the electronic devices 21.

Figure 8A:
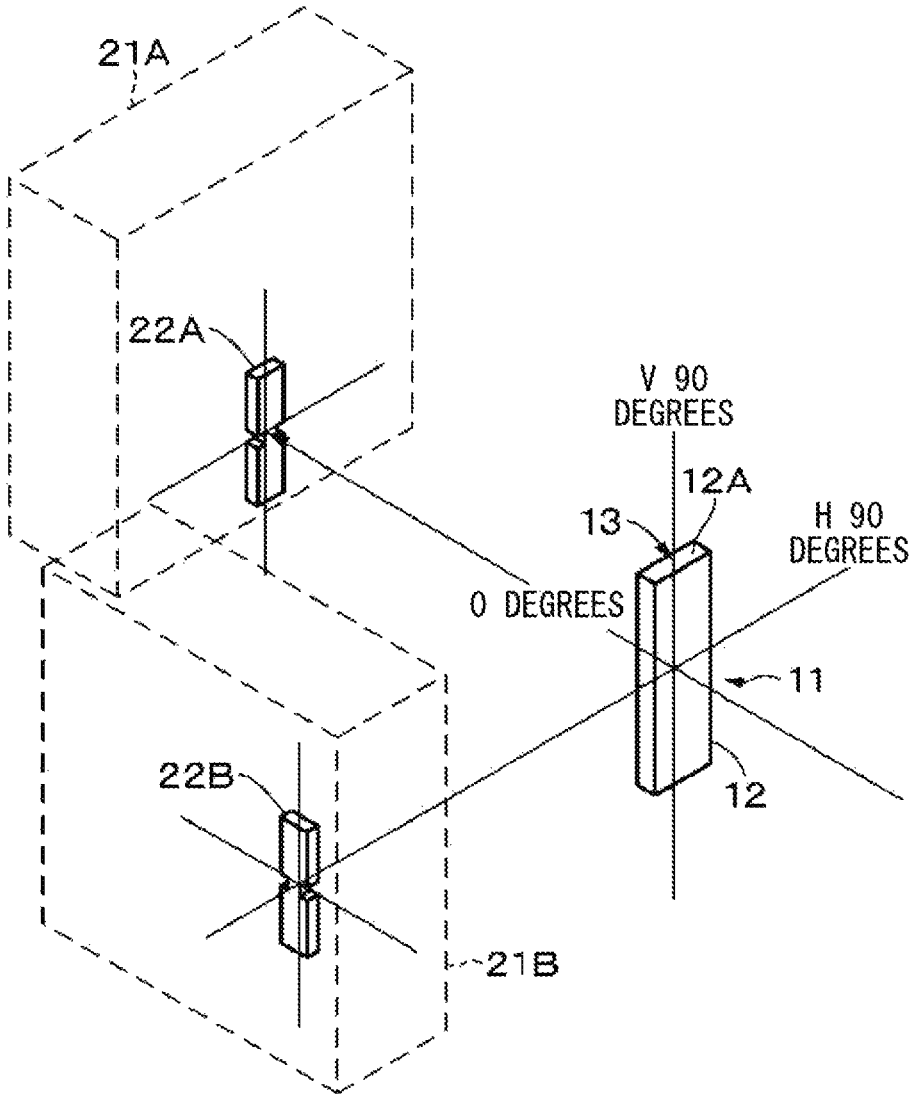
FIG. 8A is a diagram for explaining a problem that can be caused due to a positional relationship between electronic devices.
Figure 8B:
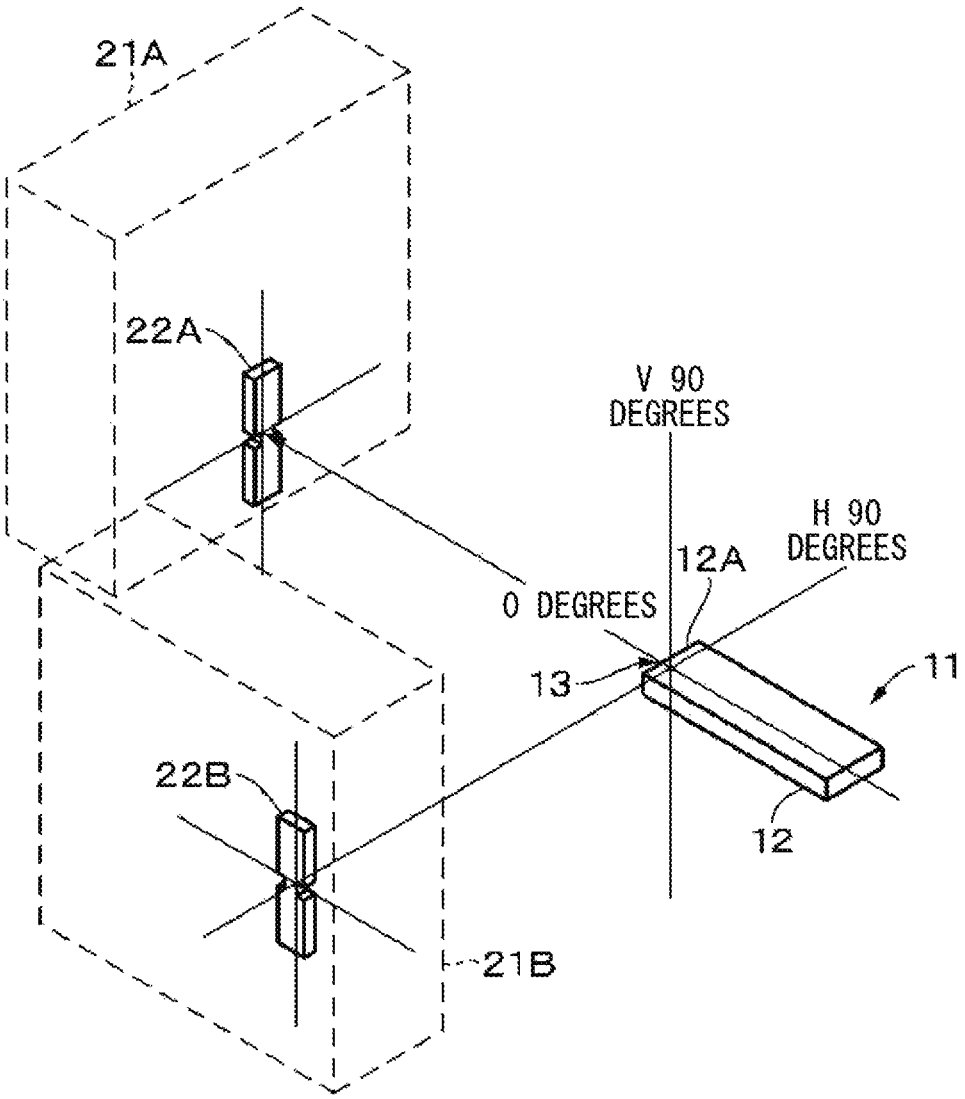
FIG. 8B is a diagram for explaining a problem that can be caused due to a positional relationship between electronic devices.

First, the problem that can be caused due to the positional relationship between the electronic devices 21 will be described with reference to FIGS. 8A and 8B. FIGS. 8A and 8B show two electronic devices 21A and 21B, and the electronic devices 21A and 21B include antennas 22A and 22B, respectively. The electronic devices 21A and 21B are each disposed at a location where the electronic device makes an angle of substantially 90 degrees with respect to the remote control device 11. Assume that the swing operation has been performed on the remote control device 11 as shown in FIGS. 8A and 8B. Assume that the electronic device 21A to which the end of the remote control device 11 is directed in the state where the operation of swinging the remote control device 11 is finished is the electronic device to be operated by the user.

As for the antenna 22A, a change of the RSSI according to the swing operation will be considered. Since the state where the remote control device 11 is swung up as shown in FIG. 8A corresponds to 90 degrees in the characteristics shown in FIG. 5A, the strength of the radio wave received by the antenna 22A increases. On the other hand, since the state where the remote control device 11 is swung down as shown in FIG. 8B corresponds to 0 degrees in the characteristics shown in FIG. 5A, the strength of the radio wave received by the antenna 22A decreases.

Next, as for the antenna 22B, a change in the RSSI according to the swing operation will be considered. Since the state where the remote control device 11 is swung up as shown in FIG. 8A corresponds to 90 degrees (or 270 degrees) in the characteristics shown in FIG. 6B, the strength of the radio wave received by the antenna 22B increases. On the other hand, since the state where the remote control device 11 is swung down as shown in FIG. 8B corresponds to 90 degrees (or 270 degrees) in the characteristics shown in FIG. 5B, the strength of the radio wave received by the antenna 22B decreases because the polarization of the antenna 13 does not match the polarization of the antenna 22B.

As described above, in the state shown in FIG. 8A, the polarizations of the antennas 22A and 22B match each other and the RSSI increases in terms of the directivity of the antenna 13 of the remote control device 11. On the other hand, in the state shown in FIG. 8B, the polarization of the antenna 22A does not match and the RSSI decreases in terms of the directivity of the antenna 13 of the remote control device 11. Also, the polarization of the antenna 22B does not match and the RSSI decreases. In other words, the variation of the RSSI according to the swing operation of the remote control device 11 increases in both the electronic devices 21A and 21B. Originally, the remote control device 11 specifies the electronic device 21A as the control target device. However, the remote control device 11 may specify the electronic device 21B as the control target device depending on the magnitude of a loss due to a mismatch between the polarizations. The second embodiment is an embodiment to deal with this problem.

As for a Cross-Shaped Antenna

Figure 9A:
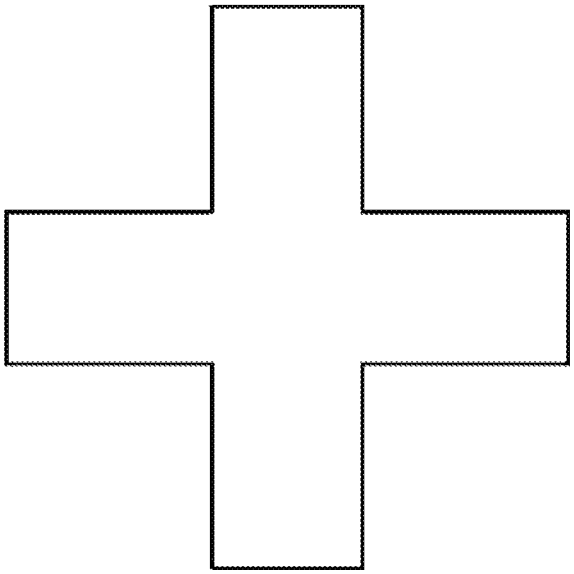
FIG. 9A is a diagram for explaining a cross-shaped antenna according to a second embodiment.
Figure 9B:
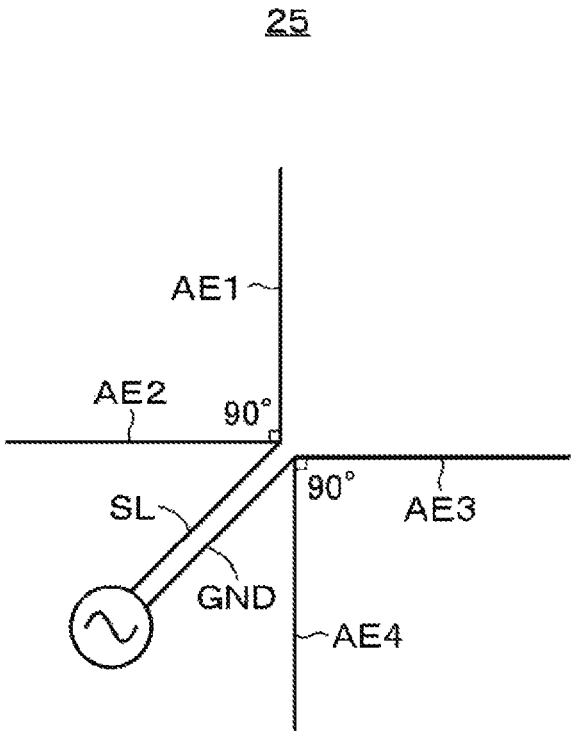
FIG. 9B is a diagram for explaining a cross-shaped antenna according to a second embodiment.

The electronic device 21 in the second embodiment includes an antenna 25 instead of the antenna 22. FIG. 9A is a diagram schematically showing the shape of the antenna 25, and FIG. 9B is a diagram showing a specific configuration example of the antenna 25. The antenna 25 has a substantially cross shape. Specifically, the antenna 25 has a shape in which two antenna elements AE1 and AE2 which are connected to a signal line SL are disposed in such a manner that the antenna elements make an angle of substantially 90 degrees and two antenna elements AE3 and AE4 which are connected to a ground GND are disposed in such a manner that the antenna elements make an angle of substantially 90 degrees (note that the length of each antenna element is ¼λ (¼ wavelength)). That is, the antenna 25 is an antenna having a configuration in which two dipole antennas are orthogonally disposed and having a shape that reduces a loss due to a mismatch between the polarizations.

Figure 10:
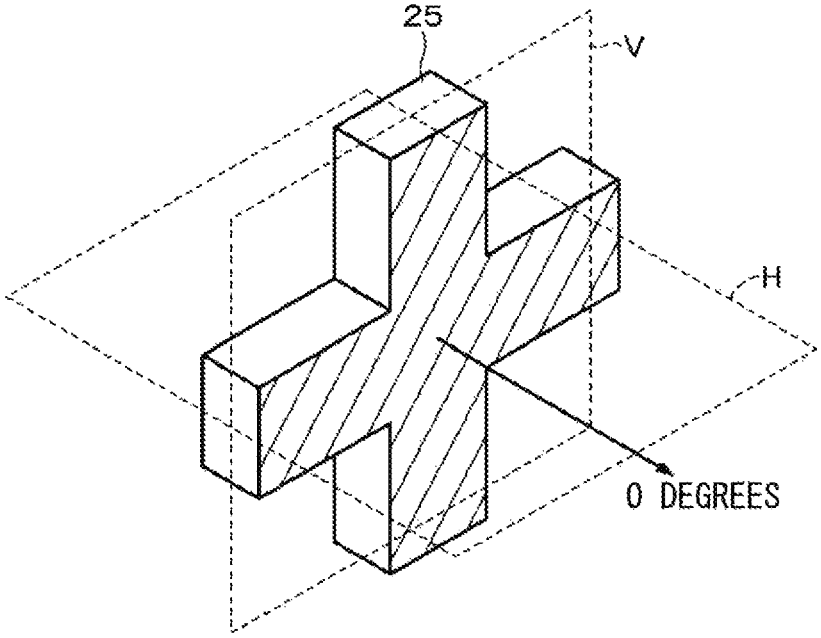
FIG. 10 is a diagram for explaining reception characteristics of the cross-shaped antenna.

Next, the reception characteristics of the antenna 25 will be described. The description will now be made assuming that, as shown in FIG. 10, the direction orthogonal to the cross-shaped surface of the antenna 25 schematically shown is set to 0 degrees, the plane parallel to the cross-shaped surface is defined as the vertical plane (V), and the plane orthogonal to the cross-shaped surface is defined as the horizontal plane (H).

Figure 11A:
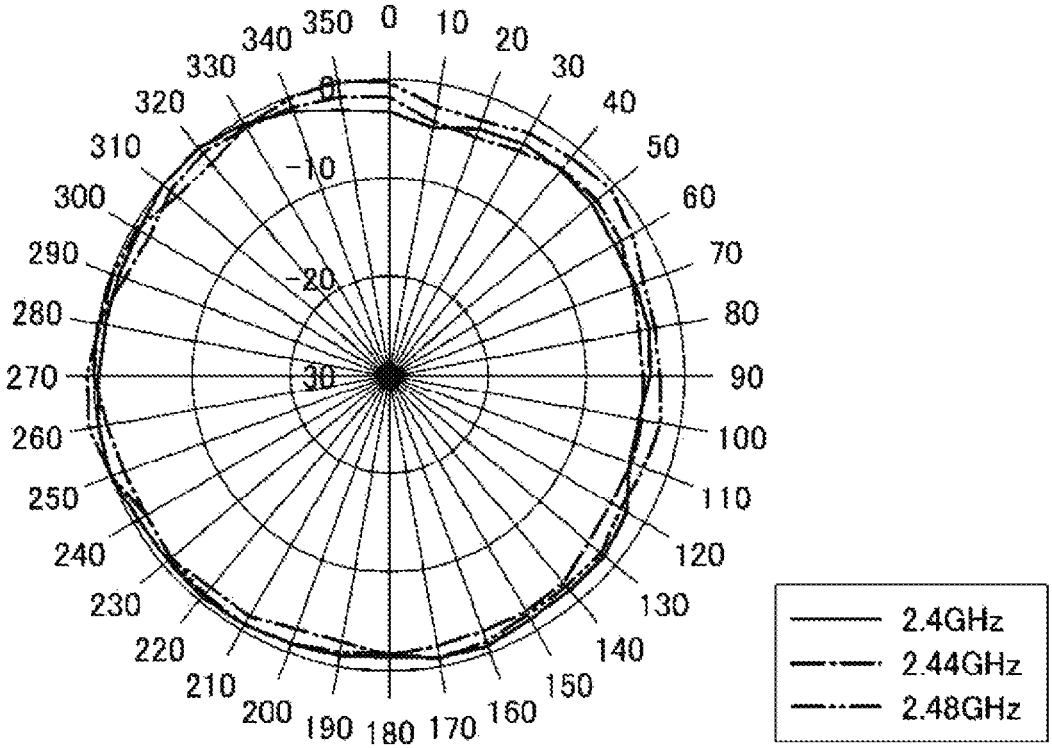
FIG. 11A is a diagram for explaining reception characteristics of the cross-shaped antenna.
Figure 11B:
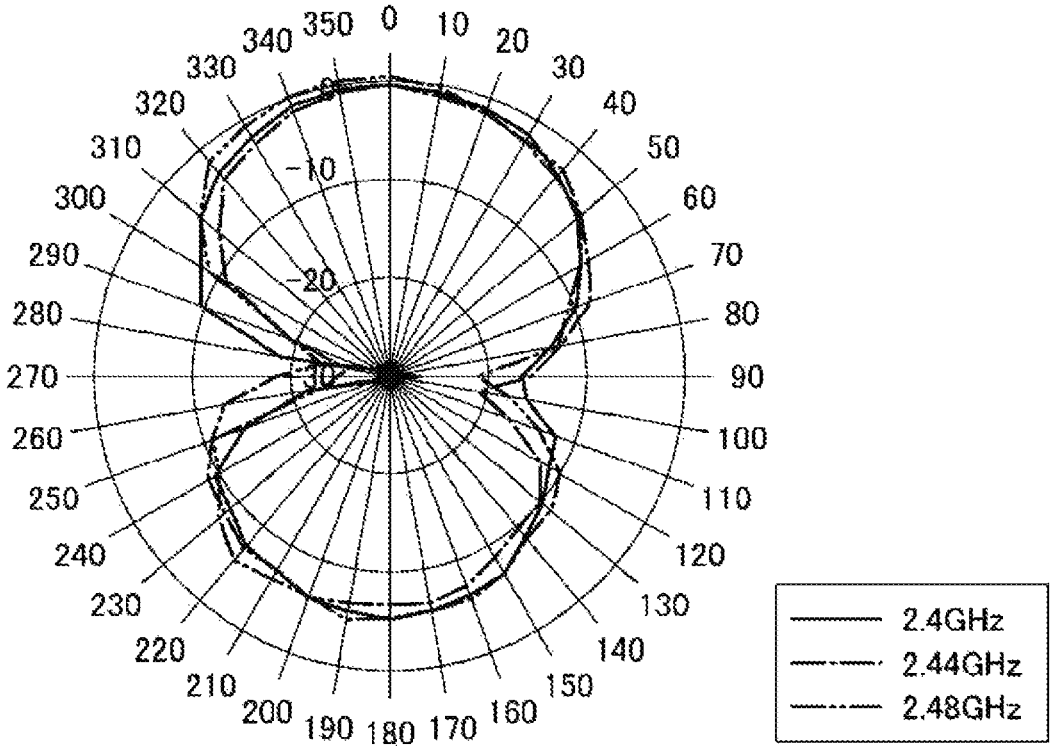
FIG. 11B is a diagram for explaining reception characteristics of the cross-shaped antenna.

FIGS. 11A and 11B show the reception characteristics of the antenna 25. FIG. 11A shows the reception characteristics in the vertical plane, and FIG. 11B shows the reception characteristics in the horizontal plane. Note that in FIGS. 11A and 11B, 2.4 GHz, 2.44 GHz, and 2.48 GHz are illustrated as frequencies of the radio wave received by the antenna 25, and the frequencies are represented by a solid line, a dashed-dotted line, and a double dashed line, respectively.

As shown in FIG. 11A, almost no decrease in the gain in the vertical plane can be seen. In the horizontal plane, the gain increases in the vicinity of 0 degrees and a remarkable decrease in the gain cannot be seen at other angles, while the gain decreases significantly in the vicinity of 90 degrees and 270 degrees (in an end face of the antenna element of the antenna 25 extending in the horizontal direction). In terms of the reception characteristics described above, it is preferable to dispose the electronic device 21 in such a manner that the vicinity of 0 degrees (cross-shaped surface) of the antenna 25 serves as the reception side.

Figure 12A:
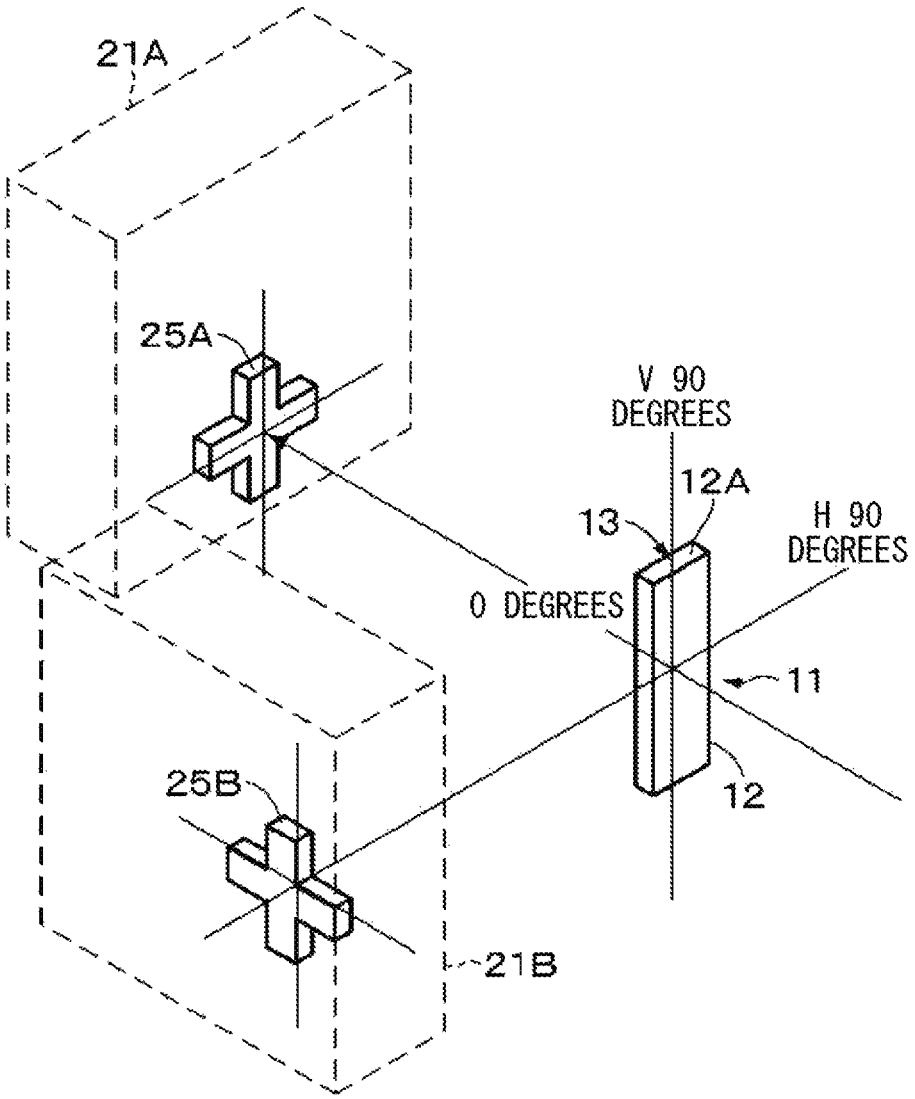
FIG. 12A is a diagram for explaining operation and effects according to the second embodiment.
Figure 12B:
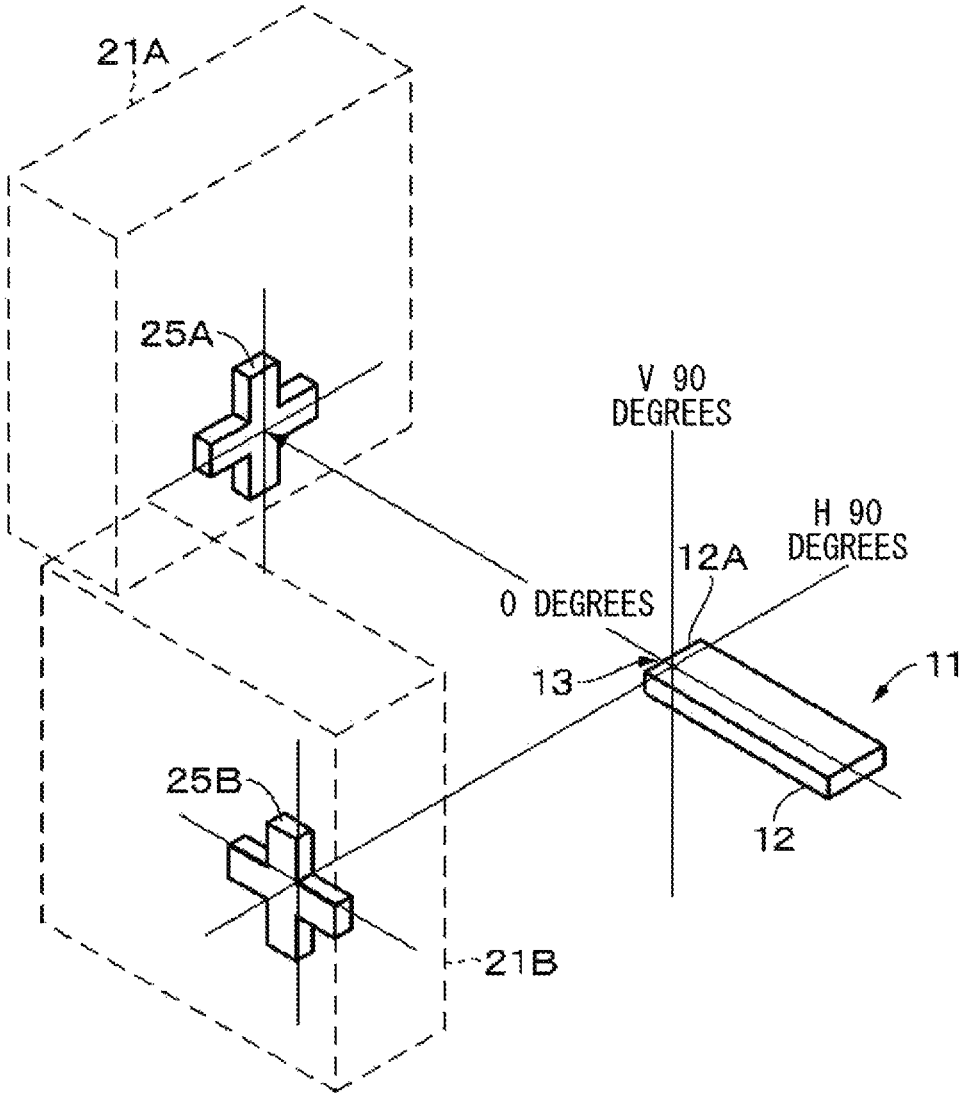
FIG. 12B is a diagram for explaining operation and effects according to the second embodiment.

Referring to FIGS. 12A and 12B, a feature that false recognition of the control target device can be prevented will be described. The positional relationship between the electronic devices 21A and 21B is similar to that shown in FIGS. 8A and 8B, and the electronic devices 21A and 21B include antennas 25A and 25B, respectively. A variation of the RSSI for antenna 25A increases for the same reason as that for the antenna 22A. Specifically, in the state shown in FIG. 12B, the polarizations match, but the RSSI decreases due to a decrease in the gain that is caused by the directivity of the antenna 13 of the remote control device 11. As a result, the variation of the RSSI increases.

In the state shown in FIG. 12A, the polarization of the antenna located in the vertical direction (located in the longitudinal direction of the cross shape) of the antenna 25B matches that of the reception side. Further, in the state shown in FIG. 12B, the polarization of the antenna located in the horizontal direction (located in the lateral direction of the cross shape) of the antenna 25B matches that of the reception side, so that no or little loss occurs. The directivity of the antenna 13 of the remote control device 11 depends on the directivity shown in FIG. 6B. Since each of the states shown in FIGS. 12A and 12B corresponds to the vicinity of 270 degrees shown in FIG. 6B, a decrease in the gain is small. Accordingly, a variation of the RSSI in the electronic device 21B does not increase, so that erroneous specification of the electronic device 21B as the control target device can be prevented.

According to the second embodiment described above, an advantageous effect that false recognition of the control target device that can be caused due to the positional relationship between the electronic devices 21 can be prevented can be obtained in addition to the advantageous effect of the first embodiment.

3. Modified Example

While the embodiments of the present disclosure have been described in detail above, the present disclosure is not limited to the above embodiments and can be variously modified.

The shape of the housing 12 of the remote control device 11 is not limited to the rectangular parallelepiped, but may be any shape such as a disc-like shape or a cylindrical shape. The housing 12 preferably has a shape in which the end to be directed to the reception side is easily recognized. Even when the end of the housing cannot be specified only by the outline shape of the housing, if the portion to be directed to the reception side is specified as a method for utilization in an instruction manual or the like, the potion can be recognized as the end of the housing.

A display, a button, or the like may be disposed on the remote control device 11. The control command according to the swing operation may be selected by the user with a button or the like.

The operation of swinging the remote control device 11 is not limited to the operation of swinging down the remote control device 11 as in the embodiment, but instead the swing operation may be an operation of swinging up the remote control device 11, or swinging forward the remote control device 11 in the horizontal direction from the right-left direction, as long as the polarization of the antenna matches that of the reception side.

The remote control system 1 may be a system including a plurality of remote control devices 11, or may be a system including three or more electronic devices 21.

The antenna 13 of the remote control device 11 may be disposed so as to project from the end of the housing 12, and may be incorporated in the vicinity of the end of the housing 12.

The control target device specifying unit 16 may specify the control target device by using parameters other than the RSSI.

The control target device specifying unit 16 may operate only when the swing operation is detected by the sensor unit 17.

The control target device specifying unit 16 may obtain a variation of the RSSI based on the RSSI at a timing when the remote control device 11 is swung up and the RSSI at a timing when the remote control device 11 is swung down. The method of calculating a variation of the RSSI is not limited to that described in the above embodiments.

The storage unit 15 may delete the stored data when the calculation of the variation of the RSSI is completed or when a predetermined amount of data is accumulated, and may store a newly acquired RSSI.

The antennas 13, 22, and 25 are not limited to the dipole antenna, the monopole antenna, and the cross-shaped antenna, respectively, and any antenna can be adopted as long as the antenna has directivity that provides the operation and effect of the present disclosure.

The antenna 22 and the cross-shaped antenna 25 (the communication unit 23 and the RSSI acquisition unit 24 may also be included) may be detachably mounted to the electronic device 21 via an appropriate interface such as a USB (Universal Serial Bus). Thus, the remote control system of the present disclosure can be easily achieved for existing electronic devices.

The control command for the electronic device 21 is not limited to a command for turning on or off the power. For example, the control command may be a command for turning up/down the volume or a channel, or for turning up/down an air conditioning set temperature.

The present disclosure can also be applied to game systems, such as an amusement park, and systems for detecting the direction in which a mobile device (the remote control device 11 in the embodiment) faces. The remote control device according to the present disclosure may be incorporated in a smartphone, a cellular phone, or the like, instead of using it alone.

In the embodiments and modified examples described above, the exemplified configurations, methods, processes, shapes, materials, numerical values, and the like are merely examples. Configurations, methods, processes, shapes, materials, numerical values, and the like other than those may be used as necessary, or may be replaced by known ones. In addition, the configurations, methods, processes, shapes, materials, numerical values, and the like in the embodiments and modified examples described above can be combined with each other as long as they do not depart from the gist of the present technology.

The invention claimed is:

1. A remote control device comprising:

a communication unit that receives a plurality of received signal strengths from each of a plurality of electronic devices and transmits a predetermined control command to one of the plurality of electronic devices being a control target device; and a control target device specifying unit that specifies, as the control target device, a device among the plurality of electronic devices having a maximum variation of the plurality of received signal strengths among the plurality of electronic devices, wherein the communication unit includes a single antenna disposed at an end of a housing, and the antenna has directivity such that one of a first position of the antenna and a second position of the antenna is a substantially null direction with respect to the control target device, and the other of the first position of the antenna and the second position of the antenna is a high gain direction, and the first position of the antenna being orthogonal to the second position of the antenna.

2. The remote control device according to claim 1, wherein the communication unit transmits a radio wave with a predetermined frequency from the antenna to the plurality of electronic devices.

3. The remote control device according to claim 1, wherein the antenna has directivity at which a gain of the antenna is increased at the first position where the end of the housing is moved by substantially 90 degrees in a vertical direction from the second position in the substantially null direction.

4. The remote control device according to claim 1, further comprising a sensor unit that detects whether or not a predetermined operation is performed.

5. The remote control device according to claim 4, wherein the control target device specifying unit calculates a variation of the plurality of received signal strengths from each of the plurality of electronic devices based on a first received signal strength obtained at a beginning of a predetermined period of time obtained by the sensor unit, and on a second received signal strength obtained after the predetermined period of time.

6. The remote control device according to claim 1, further comprising a storage unit that stores, for each of the plurality of electronic devices, the plurality of received signal strengths received from each of the plurality of electronic devices.

7. A remote control system comprising:

a plurality of electronic devices; and a remote control device, wherein the plurality of electronic devices each include:

a first communication unit that receives a radio wave transmitted from the remote control device and transmits a plurality of received signal strengths of the radio wave to the remote control device, the first communication unit including a first antenna; and a received signal strength acquisition unit that acquires the plurality of received signal strengths, the remote control device includes:

a second communication unit that receives the plurality of received signal strengths from each of the plurality of electronic devices, and transmits a predetermined control command to one of the plurality of electronic devices being a control target device; and a control target device specifying unit that specifies, as the control target device, a device among the plurality of electronic devices having a maximum variation of the plurality of received signal strengths among the plurality of electronic devices, the second communication unit includes a single second antenna disposed at an end of a housing, and the second antenna has directivity such that one of a first position of the second antenna and a second position of the second antenna is a substantially null direction with respect to the control target device, and the other of the first position of the second antenna and the second position of the second antenna is a high gain direction, and the first position of the second antenna being orthogonal to the second position of the second antenna.

8. The remote control system according to claim 7, wherein the first antenna has a shape that reduces a loss due to a mismatch between a polarization of the first antenna and a polarization of the second antenna.

* * * * *